US007182920B2

(12) United States Patent
Carroni et al.

(10) Patent No.: US 7,182,920 B2
(45) **Date of Patent: *Feb. 27, 2007**

(54) CATALYZER

(75) Inventors: Richard Carroni, Niederrohrdorf (CH); Timothy Griffin, Ennetbaden (CH); Verena Schmidt, Baden (CH)

(73) Assignee: Alstom Technology Ltd., Baden (CH)

( * ) Notice: Subject to any disclaimer, the term of this patent is extended or adjusted under 35 U.S.C. 154(b) by 484 days.

This patent is subject to a terminal disclaimer.

(21) Appl. No.: 10/134,595

(22) Filed: Apr. 30, 2002

(65) Prior Publication Data

US 2002/0182555 A1 Dec. 5, 2002

Related U.S. Application Data

(60) Provisional application No. 60/286,997, filed on Apr. 30, 2001.

(30) Foreign Application Priority Data

Dec. 14, 2001 (CH) ..... 2299/01

(51) Int. Cl.
*B01D 50/00* (2006.01)

(52) U.S. Cl. ..... 422/180; 422/177

(58) Field of Classification Search ..... 422/173, 422/177, 180, 211, 222; 431/7, 9, 170
See application file for complete search history.

(56) References Cited

U.S. PATENT DOCUMENTS 4,154,568 A 5/1979 Kendall et al.
5,202,303 A 4/1993 Retallick et al.
5,228,847 A * 7/1993 Lywood et al. ..... 431/7

(Continued)

FOREIGN PATENT DOCUMENTS

EP 0 433 223 A1 6/1991
WO 93-25852 12/1993

OTHER PUBLICATIONS

Patent Abstracts of Japan, Publication No. 57115609 dated Jul. 19, 1982.

(Continued)

*Primary Examiner*—Glenn Caldarola
*Assistant Examiner*—Tom P. Duong
(74) *Attorney, Agent, or Firm*—Buchanan, Ingersoll & Rooney PC

(57) ABSTRACT

A catalyzer for burning part of a gaseous fuel/oxidant mixture, in particular for a burner of a power plant installation, has catalytically active channels and catalytically inactive channels and at least two sectors are arranged consecutively in the main flow direction. The sectors include a first sector defining an inlet sector and at least one following sector that includes one or more of a mixing sector arranged downstream from the inlet sector and an outlet sector. Further, the catalyzer has one or more of a smaller flow resistance in the inlet sector than any following sector, a higher catalytic activity in the inlet sector than any following sector, a plurality of holes in the mixing sector oriented transversely to the main flow direction and through which adjoining channels communicate, and a swirl generator in the outlet sector that provides a swirl to a gas mixture flowing through the outlet sector.

1 Claim, 2 Drawing Sheets

U.S. PATENT DOCUMENTS

| | | | | |
|---|---|---|---|---|
| 5,346,389 | A | 9/1994 | Retallick et al. | |
| 5,437,099 | A | 8/1995 | Retallick et al. | |
| 6,179,608 | B1 | 1/2001 | Kraemer et al. | |
| 6,663,379 | B2 * | 12/2003 | Carroni et al. | 431/170 |
| 6,887,067 | B2 * | 5/2005 | Griffin et al. | 431/9 |

OTHER PUBLICATIONS

Patent Abstracts of Japan, Publication No. 57210207 dated Dec. 23, 1982.

Richard Carroni et al, U.S. Appl. No. 10/134,590 entitled "*Catalyzer*" filed Apr. 30, 2002.

* cited by examiner

CATALYZER

This application claims priority under 35 U.S.C. §§ 119 and/or 365 to 2001 2299/01 filed in Switzerland on Dec. 14, 2001, and to U.S. Provisional Application No. 60/286,997, entitled "Design of Catalytic Combustor for Optimal Heat and Mass Transfer in Combination with Ideal Flow Properties" filed on Apr. 30, 2001, the entire contents of both applications are hereby incorporated by reference.

FIELD OF THE INVENTION

The invention relates to a catalyzer for burning part of a gaseous fuel/oxidant mixture flowing through the catalyzer.

BACKGROUND OF THE INVENTION

U.S. Pat. No. 5,346,389, U.S. Pat. No. 5,202,303, and U.S. Pat. No. 5,437,099 disclose catalyzers of an initially mentioned type, each of which comprises several catalytically active channels and several catalytically inactive channels. The known catalyzers are produced using zigzag-shaped corrugated or folded sheets that are layered by way of a helical winding or folding back and forth. The corrugations or folds then form the channels of the catalyzer. One side of the respective sheet is constructed catalytically active by way of a catalyzer coating. In this way, the layering creates the catalytically active channels and the catalytically inactive channels. It is hereby possible to arrange the catalyzer coating in strip form transversely to the main flow direction on the sheet, so that an uncoated strip is positioned in the main flow direction of the catalyzer between two coated strips. Inside the catalytically active channels, the conversion or combustion of the fuel/oxidant mixture takes place in the coated areas. In essence, no conversion or combustion of the mixture takes place in the uncoated areas or in the catalytically inactive channels, so that this part of the mixture flow can be used for removing heat, i.e., for the cooling of the catalyzer.

U.S. Pat. No. 4,154,568 discloses a catalyzer of a principally different construction that is provided with several monolith blocks arranged consecutively in the main flow direction. The monolith blocks contain channels that are all catalytically active and extend parallel to the main flow direction. The channels of a monolith block located downstream have a smaller flow cross-section than those of the monolith block located upstream. This is meant to achieve a complete combustion of the fuel/oxidant mixture inside the catalyst, while in the catalyzers of this class only part of the gas mixture is supposed to be burned.

The burning of lean natural gas/air mixtures, for example with $\lambda=2$, based on palladium or platinum catalyzer materials requires temperatures of approximately 500° C. For special catalyzer materials, the ignition temperature can be reduced to 450° C. or less. The combustion reaction is kinetically limited during ignition. However, after the ignition of the combustion reaction, an increase in the catalytic activity of the catalyzer results in very high temperatures that are unsuitable for a permanent operation of the catalyzer. Accordingly, only part of the mixture is burned in the known catalyzers. The remaining fuel is supposed to be converted downstream from the catalyzer, for example in a suitable combustion chamber, by way of a homogeneous combustion. If, however, the fuel/oxidant mixture already becomes too hot inside the catalyzer, the homogeneous combustion also may start there, inside the channels, destroying the catalyzer.

Because of the one-sided coating with catalyzer material and a corresponding stacking or layering of the sheets used to construct the catalyzer, a catalyzer construction can be achieved, in which approximately half of all channels are completely catalytically coated, while the other half of the channels are uncoated. This makes it possible to effectively reduce the temperature increase in the catalyzer since the combustion of the mixture in the catalyzer is limited to the catalytically active channels and therefore to approximately 50%. While therefore almost no fuel exits from the catalytically active channels, almost unchanged mixture flows from the catalytically inactive channels. This results in a high fluctuation of the fuel concentration at the catalyzer outlet. If a combustion of the remaining fuel occurs before the partial flows exiting from the catalytically active channels and from the catalytically inactive channels are completely mixed with each other, temperature peaks may occur in association with the undesired production of NOx. Furthermore, the thickness of the boundary layer along the channel length may increase so that the conversion of the mixture takes place only slowly.

In a catalyzer with catalytically active channels and catalytically inactive channels, the catalyzer temperature or the outlet temperature of the gas mixture can be adjusted so low that the catalyzer has an adequate stability. In order to be able to thermally stabilize a homogeneous combustion, such as is necessary, for example, for generating hot gases for the operation of a gas turbine in a power plant installation, downstream from the catalyzer, for example in a combustion chamber, relatively high temperatures are necessary.

SUMMARY OF THE INVENTION

The invention means to remedy this. The invention is concerned with disclosing an improved embodiment for a catalyzer of the initially mentioned type.

In an exemplary embodiment, a catalyzer for burning part of a gaseous fuel/oxidant mixture flowing through the catalyzer has a plurality of catalytically active channels, a plurality of catalytically inactive channels, and at least two sectors arranged consecutively in a main flow direction. The at least two sectors include a first sector defining an inlet sector having the inflow side of the catalyzer and at least a second sector, the inlet sector having a smaller flow resistance than the second sector or any following sectors.

In an exemplary embodiment, a catalyzer for burning part of a gaseous fuel/oxidant mixture flowing through the catalyzer has a plurality of catalytically active channels, a plurality of catalytically inactive channels, and at least two sectors arranged consecutively in a main flow direction. The at least two sectors include a first sector defining an inlet sector having the inflow side of the catalyzer and at least a second sector, the inlet sector having a higher catalytic activity than the second sector or any following sectors.

In an exemplary embodiment, a catalyzer for burning part of a gaseous fuel/oxidant mixture flowing through the catalyzer has a plurality of catalytically active channels, a plurality of catalytically inactive channels, and at least two sectors arranged consecutively in a main flow direction. The at least two sectors include a first sector defining an inlet sector having the inflow side of the catalyzer and at least a second sector defining a mixing sector and arranged downstream from the inlet sector, the channels of said mixing sector having a plurality of holes oriented transversely to the main flow direction and through which adjoining channels communicate.

In an exemplary embodiment, a catalyzer for burning part of a gaseous fuel/oxidant mixture flowing through the catalyzer has a plurality of catalytically active channels, a plurality of catalytically inactive channels, and at least two sectors arranged consecutively in a main flow direction. The at least two sectors include a first sector and at least a second sector defining an outlet sector having an outflow side of the catalyzer, the outlet sector constructed as a swirl generator that provides a swirl to a gas mixture flowing through the outlet sector.

In an exemplary embodiment, a catalyzer for burning part of a gaseous fuel/oxidant mixture flowing through the catalyzer has a plurality of catalytically active channels, a plurality of catalytically inactive channels, and a plurality of sectors arranged consecutively in a main flow direction, each sector comprising a portion of the plurality of catalytically active and catalytically inactive channels. The plurality of sectors include a first sector defining an inlet sector having the inflow side of the catalyzer and at least one following sector that includes one or more from the group of: a mixing sector arranged downstream from the inlet sector and an outlet sector comprising an outflow side of the catalyzer. Further, the catalyzer includes one or more from the group of: a smaller flow resistance in the inlet sector than any following sector, a higher catalytic activity in the inlet sector than any following sector, a plurality of holes in the mixing sector and oriented transversely to the main flow direction and through which adjoining channels communicate, and a swirl generator in the outlet sector that provides a swirl to a gas mixture flowing through the outlet sector.

BRIEF DESCRIPTION OF THE DRAWINGS

Preferred embodiments of the invention are disclosed in the following description and illustrated in the accompanying drawings, in which.

DETAILED DESCRIPTION OF THE INVENTION

The invention is based on the general idea of dividing the catalyzer in the main flow direction into at least two consecutively arranged sectors, whereby these sectors are constructed according to a first variation with respect to their flow resistance values in such a way that an inlet sector comprising the inflow side of the catalyzer has a smaller flow resistance than the following sector or sectors. The reduced pressure loss in the inlet sector makes it possible to reduce the overall pressure loss of the catalyzer. Overall, this permits a shorter construction of the catalyzer.

According to a second variation, the sectors of the catalyst can be constructed so that the inlet sector has a higher catalytic activity than the following sector or sectors. As a result of this measure, increased conversion rates for the fuel/oxidant mixture result in the inlet sector, so that higher temperatures are achieved, and the catalytic reactions in the following sectors also may take place adequately with a reduced catalytic activity.

According to a third variation, a mixing sector may be positioned downstream from the inlet sector, where the channels of said mixing sector have holes transversely to the main flow direction, through which the adjoining channels are communicating and in this way permit an exchange of gas or matter between the channels. As a result of this construction, a mixing of the hot combustion waste gas flowing in the catalytically active channels with the relatively cold, unburned fuel/oxidant mixture flowing in the catalytically inactive channels may take place in the mixing sector. This permits an increase of the degree of conversion, in particular above 50%, inside the catalyzer. This measure also makes it possible to reduce the concentration gradients at the catalyzer outlet. Temperature peaks and the formation of harmful substances, in particular the formation of NOx, can hereby be reduced.

According to a fourth variation, an outlet sector comprising the outflow side of the catalyzer can be constructed as a swirl generator that provides the gas mixture flowing through with a swirl. This measure creates a swirl flow downstream from the catalyzer, which swirl flow makes it possible to improve a homogeneous and stabile combustion downstream from the catalyzer, in particular in a combustion chamber. As a result of the swirl flow, recirculation zones can be generated in the combustion chamber, especially in connection with an abrupt increase in the cross-section, said recirculation zones forming and stabilizing a flame front in the combustion chamber.

Figure 1:
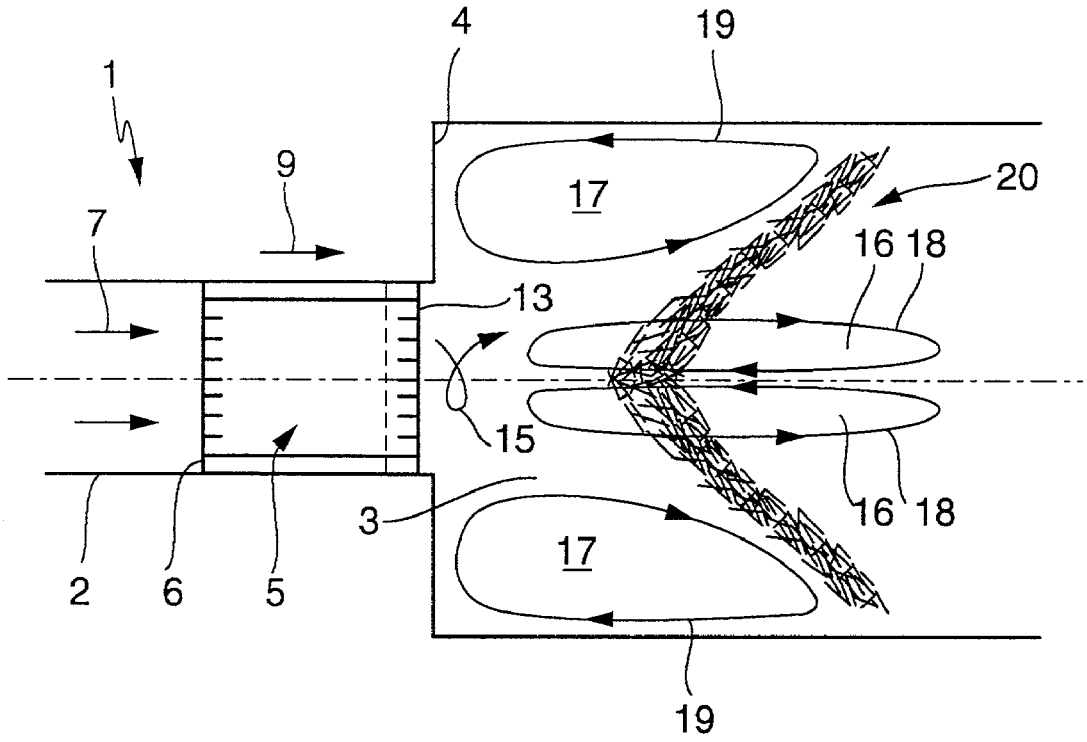
FIG. 1 is a greatly simplified principle view of a burner arrangement provided with the catalyzer according to the invention.

According to FIG. 1, a burner arrangement 1 comprises a feed line 2 and a combustion chamber 3 that follows the feed line 2 via an abrupt cross-section increase 4. In the feed line 2, a catalyzer 5 according to the invention, serving as a burner, is arranged, which is constructed so as to allow a flow through it, and which is impacted with the fuel/oxidant mixture 7, symbolized by arrows, on its inflow side 6. The burner arrangement 1 is used, for example, to generate hot gases for a turbine, especially a gas turbine, of a power plant installation.

Figure 2:
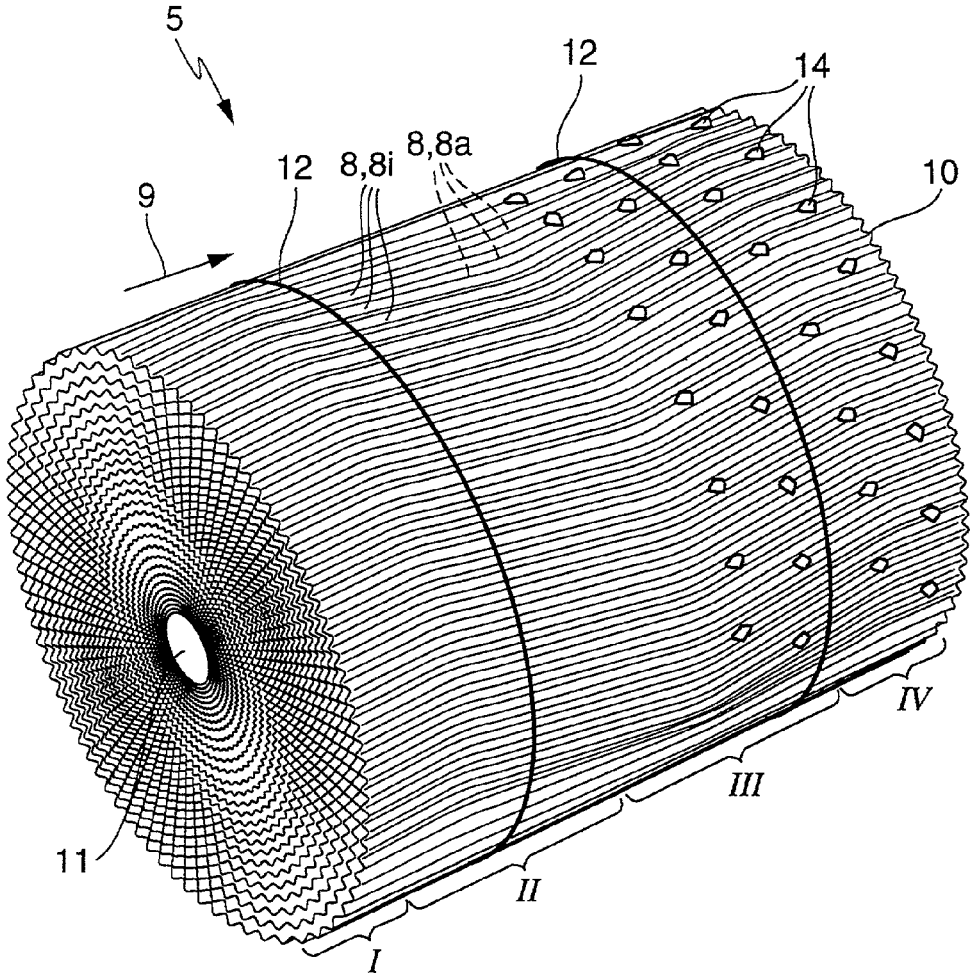
FIG. 2 is a perspective view onto a catalyzer according to the invention.

According to FIG. 2, the catalyzer 5 according to the invention comprises a plurality of channels 8 that extend essentially parallel to each other and extend through the catalyzer 5 in its main flow direction 9 symbolized by an arrow. Some of the channels 8 are constructed as catalytically active channels **8*a*, and the remaining ones as catalytically inactive channels 8*i*, The catalytic activity, for example, can be realized with a corresponding catalyzer coating of the catalyzer carrier structure, while the catalytically inactive areas are then uncoated. The catalytically active channels 8*a* and catalytically inactive channels 8*i* can alternate, preferably alternate as regularly as possible, to achieve an even temperature distribution in the catalyzer 5**.

The catalyzer 5 can be produced, for example, by helically winding a corrugated or folded band-shaped web material 10, consisting, for example, of a metal sheet, onto a spindle 11. The winding then can be held in shape with the help of tension wires 12. The catalyzer 5 thus forms a unit that is relatively easy to handle. In order to be able to position adjoining channels 8 in radial direction clearly in relation to each other, it is useful to place onto the first web material a second web material, also of sheet metal, and to wind this composite onto the spindle 11. The second web material also can be corrugated or folded, whereby the corrugations or fold patterns of the web materials differ from each other in such a way that channels 8 positioned on top of each other intersect once or several times in order to achieve a dimensionally stable packing for the catalyzer 5. However, the second web material also can be constructed flat or smooth in order to ensure the radial positioning of the channels 8.

Figure 3:
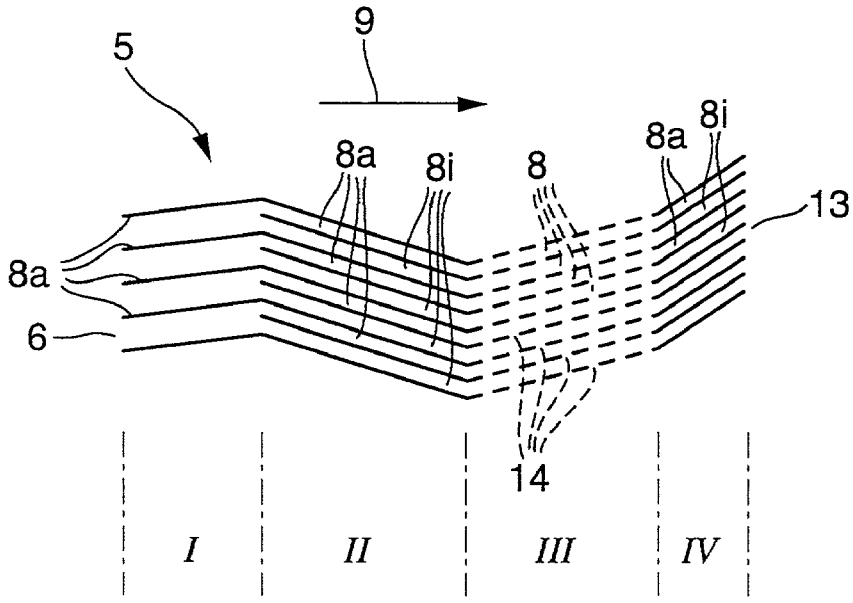
FIG. 3 is a principle view of the catalyzer structure.

FIG. 3 shows a greatly simplified illustration of the construction of the catalyzer 5 for a special embodiment, whereby this illustration is obtained from, for example, a section inside the catalyzer 5 in the circumferential direction. Accordingly, some of the individual, adjoining channels 8 or 8*a* and 8*i* can be recognized.

According to FIGS. 2 and 3, the catalyzer 5 according to the invention is divided into several, here four, sectors I to IV, whereby the individual sectors I to IV are arranged consecutively in the main flow direction 9. In FIG. 2, the individual sectors I to IV are symbolized by braces, while the sector limits in FIG. 3 are suggested by vertical lines. In particular, the sectors I to IV are a preceding inlet sector I comprising the inflow side 6 of the catalyzer 5. Downstream from the inlet sector I, an intermediate sector II follows directly. This intermediate sector II is followed directly by a mixing sector III. The sector furthest to the back comprises an outflow side 13 of the catalyzer 5 and in this way forms an outlet sector IV. The inlet sector I is constructed so that it has a smaller flow resistance than the directly following intermediate sector II. It is useful that the flow resistance of the inlet sector I is also smaller than the flow resistance of the mixing sector III and of the outlet sector IV. By way of this construction, the pressure loss is reduced at the entrance into the channels 8 of the catalyzer 5, so that the overall pressure loss above the catalyzer 5 is reduced. This is achieved, for example, in that the channels 8 or 8*a* of the inlet sector I have a smaller slant in relation to the main flow direction 9 than the channels 8 of the following intermediate sector II or all following sectors II to IV. In a special case, the channels 8 or 8*a* of the inlet sector 1 also may have a slant with a value of zero, i.e. the channels 8 or 8*a* of the inlet sector I then extend parallel to the main flow direction 9.

In the embodiment shown here, fewer channels 8 or 8*a* are constructed in the inlet sector I than in the following sectors II to IV. At the same time, the channels 8 or 8*a* of the inlet sector I may have larger flow cross-sections than the channels 8 of the following sectors II to IV. Larger flow cross-sections facilitate the ignition or the start of the catalytic reaction, since the transport of heat and mailer transversely to the catalytically active channel wall, in particular under laminar conditions, behaves reciprocally proportional to the distance from the channel wall. Because of these measures, the inlet sector I has a smaller flow resistance than the following sectors II to IV. While in the inlet sector I the lower cell density (number of channels 8 per cross-section area) improves the ignition, the higher cell density increases the throughput or conversion of the fuel in the following sectors II to IV. Additionally or alternatively, turbulators or other turbulence elements, not shown here, can be arranged in particular in the intermediate sector II, which turbulators indeed increase the flow resistance in the intermediate sector II in relation to the inlet sector I, which, however, improve the mixing of the gases in the channels 8, with the result that in the catalytically active channels 8*a* the catalytic reaction rate, and in the catalytically inactive channels 8*i* the heat transfer to the flow are increased. Examples of suitable turbulators and other turbulence elements are disclosed in commonly owned U.S. Pat. No. 6,663,379 entitled "Catalyzer", filed on even date herewith, the entire contents of which are herein incorporated by reference.

In order to improve the ignition behavior of the catalyzer 5 and to stabilize the catalytic combustion reaction, the inlet sector I can be constructed so that it has a higher catalytic activity than the following sectors II to IV. This is achieved, for example, in that for the inlet sector I a catalyzer material is used that has a higher catalytic activity than the catalyzer material used for the following sectors II to IV. In the catalyzer material of the inlet sector I, for example, the precious metal content (for example, palladium and/or platinum) can be increased. It is furthermore possible to select the portion of catalytically active channels 8*a* higher in the inlet sector I than in the following sectors II to IV. In the embodiment shown in FIG. 3, all channels 8 of the inlet sector I are constructed as catalytically active channels 8*a*. Alternatively, it is also possible to increase the total number of channels 8 in the inlet sector I.

In the mixing sector III, adjoining channels 8 or 8*a* and 8*i* are able to communicate with each other in order to achieve an exchange of gas or matter between the channels 8. For this purpose, the channels 8 comprise holes 14 transversely to the main flow direction, through which holes the desired exchange of matter or gas may take place between adjoining channels 8. Accordingly, a mixing of the (partially) burned mixture of the catalytically active channels 8*a* with the (essentially) unburned mixture of the catalytically inactive channels 8*i* takes place. If catalytically active channels 8*a* are also constructed in the mixing sector III, the degree of conversion of the flow flowing through the catalyzer 5 can be further increased, in particular to values above 50%. In the area of the holes 14, cross-connection means, for example wings, can be constructed, which support the gas exchange between adjoining channels 8. Suitable holes or communications are disclosed in commonly owned U.S. Pat. No. 6,663,379 entitled "Catalyzer", filed on even date herewith, the entire contents of which are herein incorporated by reference.

The outlet sector IV in the embodiment shown here is constructed as a swirl generator, i.e. the outlet sector IV provides the gas mixture flowing through it with a swirl. For this purpose, the channels 8 or 8*a* and 8*i* of the outlet sector IV extend essentially parallel to each other and slanted in relation to the main flow direction 9. It is useful that the channels 8 of the outlet sector IV hereby have a greater slant in relation to the main flow direction 9 than the channels 8 of the directly preceding mixing sector III or each of the preceding sectors I to III.

This swirl flow is symbolized in FIG. 1 by an arrow 15. According to FIG. 1, the catalyzer 5 is arranged directly before the cross-section change or abrupt cross-section increase 4. The swirl flow 15 therefore is able to immediately burst open on entering the combustion chamber 3, so that a central recirculation zone 16 as well as a radially outside, external recirculation zone 17 are able to form in the combustion chamber 3. The recirculation zones 16 and 17 are hereby formed by vortex rollers 18 or 19 that are symbolized in FIG. 1 by closed arrow lines. These recirculation zones 16 and 17 generate or stabilize and position a flame front 20 in the combustion chamber 3, which flame front ensures a homogeneous combustion of the mixture exiting from the catalyzer 5.

In the embodiment according to FIG. 3, the channels 8, in the intermediate sector II, are slanted in a first direction, according to FIG. 3 downwards, in relation to the main flow direction 9, while the channels 8 in all other sectors I, III, and IV are slanted in the opposite direction, according to FIG. 3 upwards, in relation to the main flow direction 9. The double deflection on entering the intermediate sector II and exiting from the intermediate sector II makes it possible to increase the mixing of the gases inside a channel 8 in the catalyzer 5, in particular in the intermediate sector II.

Principally, it is possible to construct one or more of the sectors I to IV in each case as a separate component, which components are then assembled for constructing the catalyzer 5. Useful, however, is an embodiment in which two or more, preferably all, sectors I to IV are constructed integrally in a one-piece component. This results in clear geometries for the channels 8 as well as reproducible flow conditions. The production of the catalyzer 5 also can be significantly simplified with this.

What is claimed is:

1. A catalyzer for burning part of a gaseous fuel/oxidant mixture flowing through the catalyzer, the catalyzer comprising:

a plurality of catalytically active channels;

a plurality of catalytically inactive channels; and a plurality of sectors arranged consecutively in a main flow direction, each sector comprising a portion of the plurality of catalytically active and catalytically inactive channels, wherein the plurality of sectors comprise at least two sectors arranged consecutively in a main flow direction, wherein the at least two sectors comprise a first sector defining an inlet sector comprising the inflow side of the catalyzer and at least a second sector defining a mixing sector arranged downstream from the inlet sector, the channels of said mixing sector comprising a plurality of holes oriented transversely to the main flow direction and through which adjoining channels of the mixing sector communicate;

wherein the plurality of sectors comprise an outlet sector comprising an outflow side of the catalyzer, the outflow sector constructed as a swirl generator that provides a swirl to a gas mixture flowing through the outlet sector; and wherein the catalyzer includes at least one of a smaller flow resistance in the inlet sector than any following sector, and a higher catalytic activity in the inlet sector than any following sector.

* * * * *